US012312763B2

(12) United States Patent
Kumbhar et al.

(10) Patent No.: US 12,312,763 B2
(45) Date of Patent: May 27, 2025

(54) LINKAGE ASSEMBLY FOR CONSTRUCTION MACHINE

(71) Applicant: Deere & Company, Moline, IL (US)

(72) Inventors: Nilesh Kumbhar, Dubuque, IA (US); Brett S. Graham, Dubuque, IA (US); Eric Vilar, Dubuque, IA (US); Giovanni A. Wuisan, Dubuque, IA (US)

(73) Assignee: Deere & Company, Moline, IL (US)

( * ) Notice: Subject to any disclaimer, the term of this patent is extended or adjusted under 35 U.S.C. 154(b) by 226 days.

(21) Appl. No.: 17/979,900

(22) Filed: Nov. 3, 2022

(65) Prior Publication Data

US 2024/0150992 A1 May 9, 2024

(51) Int. Cl.
*E02F 3/34* (2006.01)

(52) U.S. Cl.
CPC ..... *E02F 3/3408* (2013.01); *E02F 3/3414* (2013.01)

(58) Field of Classification Search
CPC ..... E02F 3/3408; E02F 3/3414
See application file for complete search history.

(56) References Cited

U.S. PATENT DOCUMENTS 3,237,794 A * 3/1966 Miller ..... E02F 9/2292 74/15.84
3,370,729 A * 2/1968 Clarke ..... E02F 3/3408 414/707
3,767,075 A † 10/1973 Leverenz
4,143,783 A † 3/1979 Cochran
4,355,946 A 10/1982 Wykhuis et al.
5,240,366 A † 8/1993 Bamford
5,405,237 A * 4/1995 Oka ..... B66F 9/065 414/722
5,807,061 A * 9/1998 Donoghue ..... E02F 3/3414 414/710
6,132,163 A 10/2000 Andrews et al.
6,916,148 B2 † 7/2005 Brown
7,059,422 B2 * 6/2006 Burgin ..... E02F 3/433 172/776
9,017,005 B2 4/2015 Martin et al.
9,783,962 B1 * 10/2017 Hitchcock ..... E02F 3/3417
10,443,209 B2 10/2019 Kumbhar et al.
10,676,893 B1 * 6/2020 Williams ..... A01D 87/122
(Continued)

OTHER PUBLICATIONS

Exhibit "A"—photos of Commander C-4200 machine (undated but admitted to be prior art).

(Continued)

*Primary Examiner* — Saul Rodriguez
*Assistant Examiner* — Brendan P Tighe
(74) *Attorney, Agent, or Firm* — Lucian Wayne Beavers; Patterson Intellectual Property Law PC

(57) ABSTRACT

A construction machine comprising a machine frame, a plurality of ground engaging units for supporting the machine frame from a ground surface, a work tool coupling, left and right boom arms pivotally supported directly or indirectly from the machine frame and pivotally connected to the work tool coupling, left and right work tool actuators mounted on the left and right boom arms, respectively, and left and right actuator linkages connecting the left and right work tool actuators, respectively, with the work tool coupling.

18 Claims, 11 Drawing Sheets

(56) References Cited

U.S. PATENT DOCUMENTS

| | | | |
|---|---|---|---|
| 2021/0270004 | A1† | 9/2021 | Durkin |
| 2022/0305923 | A1 | 9/2022 | Hagen et al. |
| 2023/0060424 | A1† | 3/2023 | Durkin |
| 2024/0068197 | A1† | 2/2024 | Durkin |
| 2024/0068199 | A1† | 2/2024 | Durkin |

OTHER PUBLICATIONS

Farm Show Magazine, vol. 17, Issue #1, p. #33, article "Rubber Tracked Crawler Loader" (1993).

* cited by examiner
† cited by third party

LINKAGE ASSEMBLY FOR CONSTRUCTION MACHINE

FIELD OF THE DISCLOSURE

The present disclosure relates to construction machines including but not limited to a skid steer loader or a compact track loader.

BACKGROUND

Construction machines perform a variety of operations. In some instances, the machines are provided with a work tool to perform a desired function. The work tool is operably coupled to a frame of the machine by a linkage and boom assembly. FIG. 1 illustrates a conventional construction machine, namely a skid steer loader, generally designated by the number 10. Conventional construction machines 10 include a plurality of actuators 20 directly connected to a work tool 22 or to a work tool coupling 24. The proximity of the actuators 20 to the work tool 22 exposes the actuators 20 to dirt and debris. These foreign contaminates damage the actuators 20 and render the actuators 20 prone to failure.

Accordingly, a need exists to provide a construction machine, and in particular, a linkage and boom assembly for the machine that alters the location of and safeguards the actuators.

SUMMARY OF THE DISCLOSURE

In one embodiment a construction machine comprises a machine frame, a plurality of ground engaging units for supporting the machine frame from a ground surface, a work tool coupling, left and right boom arms pivotally supported directly or indirectly from the machine frame and pivotally connected to the work tool coupling, left and right work tool actuators mounted on the left and right boom arms, respectively, and left and right actuator linkages connecting the left and right work tool actuators, respectively, with the work tool coupling.

In other aspects of the disclosure, the work tool coupling includes left and right boom connection points and left and right actuator connection points. Each of the left and right boom arms includes a main boom arm portion extending longitudinally from a rear boom arm end and bending downwardly at a boom knee to a lower boom arm portion having a forward boom arm end. The rear boom arm end is pivotally supported directly or indirectly from the machine frame and the forward boom arm end is pivotally connected to one of the boom connection points of the work tool coupling. The left and right actuator linkages connect the left and right work tool actuators with the left and right actuator connection points, respectively. The left and right work tool actuators are mounted on the main boom arm portions of the left and right boom arms, respectively. The left and right work tool actuators are at least partially housed within the left and right boom arms, respectively.

Numerous objects, features and advantages of the present invention will be readily apparent to those skilled in the art upon a review of following description in conjunction with the accompanying drawings.

DETAILED DESCRIPTION

Figure 2:
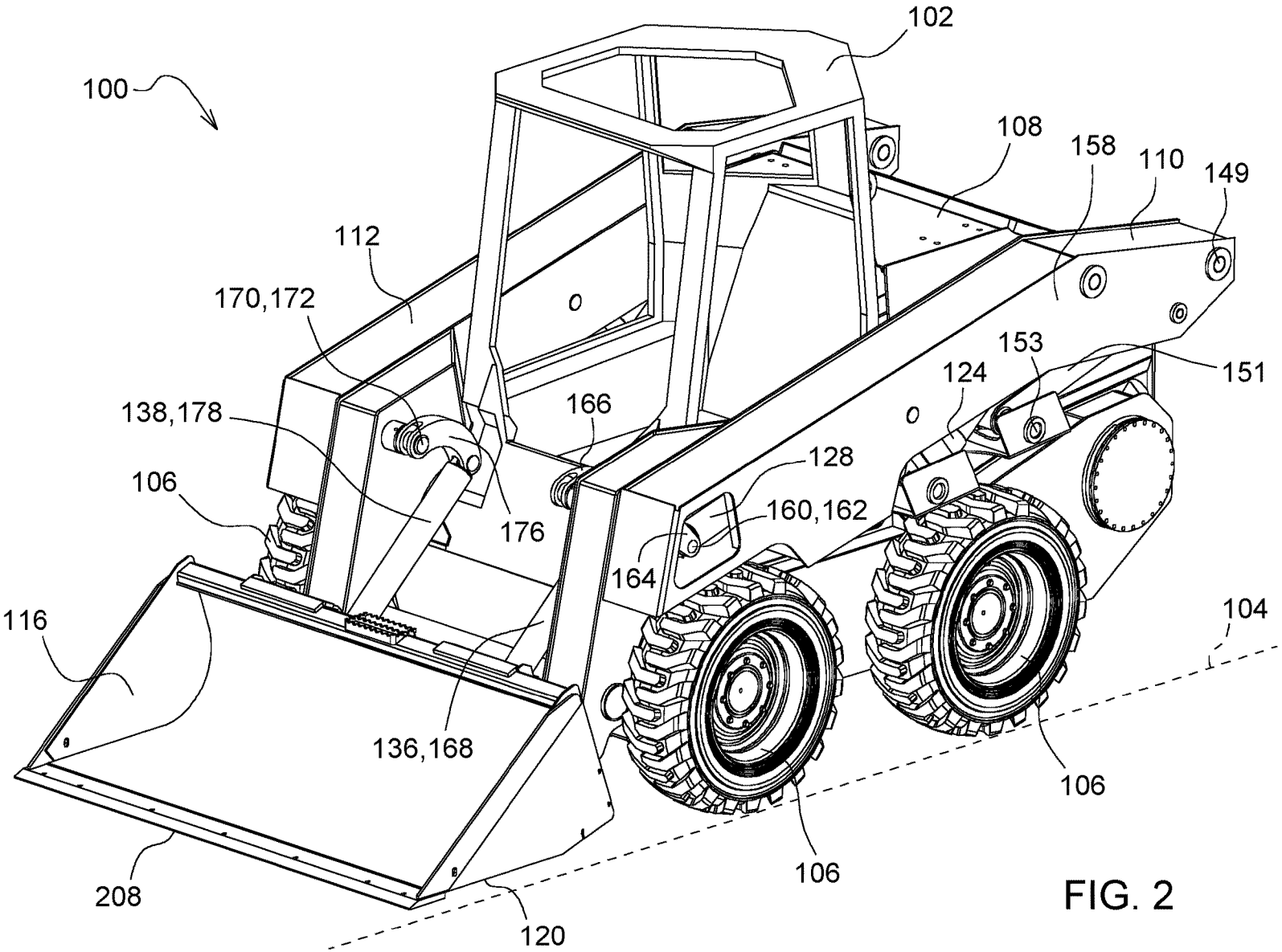
FIG. 2 is a perspective view of a construction machine, for example a skid steer loader, including the improved actuator and linkage of the present disclosure.

Referring now to the drawings and particularly to FIG. 2, a construction machine is shown and generally designated by the number 100. Construction machine 100 is illustrated as a skid steer loader, which may also be referred to as a skid steer, but may be any work vehicle which may connect to a work tool, such as a backhoe loader, compact track loader, excavator, tractor, tractor loader, and wheel loader, to name a few examples. Construction machine 100 may perform a number of operations, including excavating or loading material, shaping or smoothing ground surfaces, excavating or boring a hole, or breaking up material, to name a few operations. As used herein, directions with regard to construction machine 100 may be referred to from the perspective of an operator seated within operator station 102: the left of construction machine 100 is to the left of such an operator, the right of construction machine 100 is to the right of such an operator, the front or fore of construction machine 100 is the direction such an operator faces, the rear or aft of construction vehicle 100 is behind such an operator, the top of construction machine 100 is above such an operator, and the bottom of construction machine 100 is below such an operator.

Construction machine 100 is supported from or on the ground surface 104 by a plurality of ground engaging units generally designated by the number 106, which provide rolling support to machine frame 108 and traction. The ground engaging units 106 may be wheels as shown in FIG. 2, or alternatively may be crawler track units. The ground engaging units 106 may be powered directly or indirectly by one or more electric, internal combustion, or hydraulic motors to drive the construction machine 100. The construction machine 100 is steered as an operator manipulates controls to drive the ground engaging units 106 on the left or right of the machine frame 108 at different speeds to thereby steer the construction machine 100 in a conventional skid steer fashion.

Machine frame 108 provides strength and support to the construction machine 100, and interconnects the components of construction machine 100, including left boom arm 110 and right boom arm 112. The boom arms 110 and 112 are supported either directly or indirectly from the machine frame 108. The boom arms 110 and 112 are pivotally connected to the machine frame 108 allowing construction machine 100 to raise and lower the boom arms 110 and 112, which in turn raises and lowers a work tool coupling 114. The work tool coupling 114 is shown in its entirety in FIG. 7. The work tool coupling 114 can be an adapter for connecting a work tool, such as a bucket 116, hydraulic hammer, snow blade, and angle broom, to name a few examples. The work tool may be a non-powered tool or an electrically or hydraulically powered tool. The work tool coupling 114 can also be integrally formed onto the back of the work tool. In FIG. 2 the work tool coupling 114 is shown attached to the bucket 116. The bucket 116 includes a planar bottom 120 and can be operatively coupled with or include the work tool coupling 114.

Figure 5:
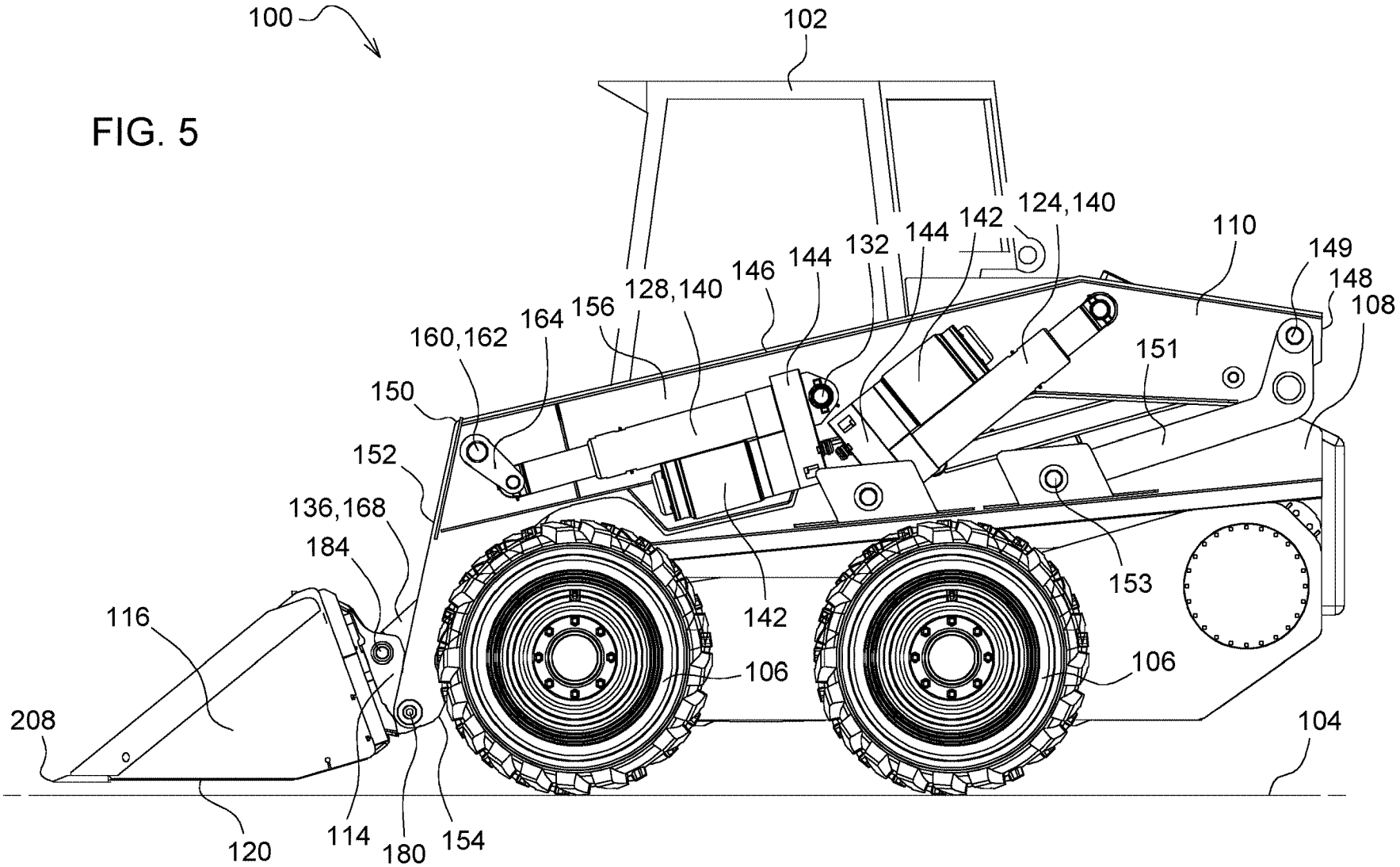
FIG. 5 is a left side view of the construction machine of FIG. 2 where the left boom arm is partially deconstructed.
Figure 6:
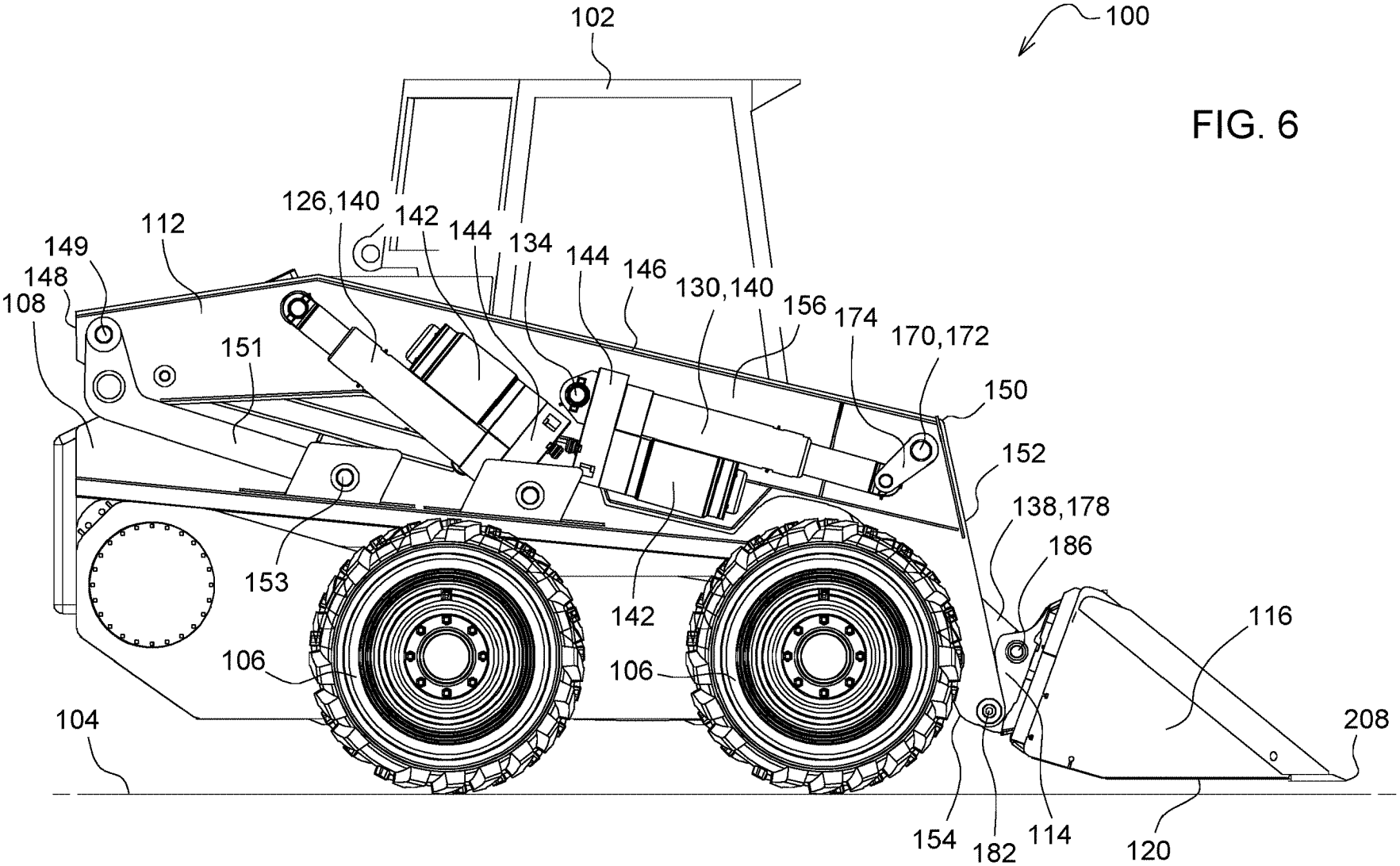
FIG. 6 is a right side view of the construction machine of FIG. 2 where a right boom arm is partially deconstructed.
Figure 10:
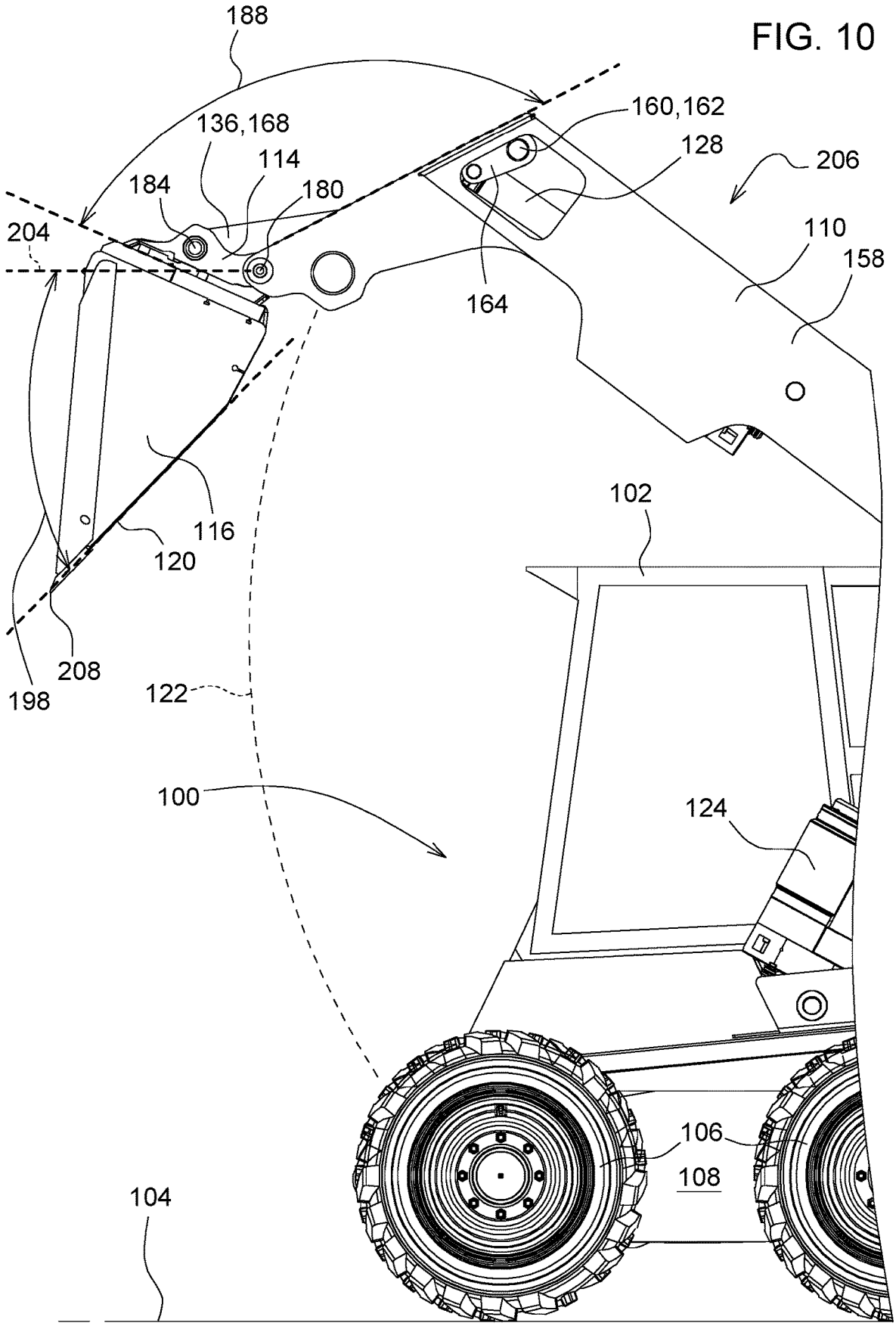
FIG. 10 is a left side partial view of the construction machine of FIG. 2 showing a dump angle.

Referring to FIGS. 5 and 6, construction machine 100 may raise and lower the boom arms 110 and 112 along a lift path 122 via the extension and retraction of left boom support actuator 124 and right boom support actuator 126. The lift path 122 is shown in FIG. 10. The boom support actuators 124 and 126 can be hydraulic cylinders or electrically powered linear actuators. The boom support actuators 124 and 126 are each pivotally coupled at one end to the machine frame 108 and at an opposite end to the left and right boom arms 110 and 112, respectively.

Work tool coupling 114 may be tilted relative to boom arms 110 and 112 by a left work tool actuator 128 and a right work tool actuator 130. The work tool actuators 128 and 130 allow the work tool attached to the work tool coupling 114 to perform a function, such as the bucket 116 which may be tilted upwards to gather material or downwards to dump material. The left work tool actuator 128 is mounted on the left boom arm 110 and the right work tool actuator 130 is mounted on the right boom arm 112. Specifically, the left work tool actuator 128 is pivotally connected to the left boom arm 110 at pivotal connection 132 and the right work tool actuator 130 is pivotally connected to the right boom arm 112 at pivotal connection 134. The pivotal connections 132 and 134 are configured to move with the respective boom arms 110 and 112.

Figure 7:
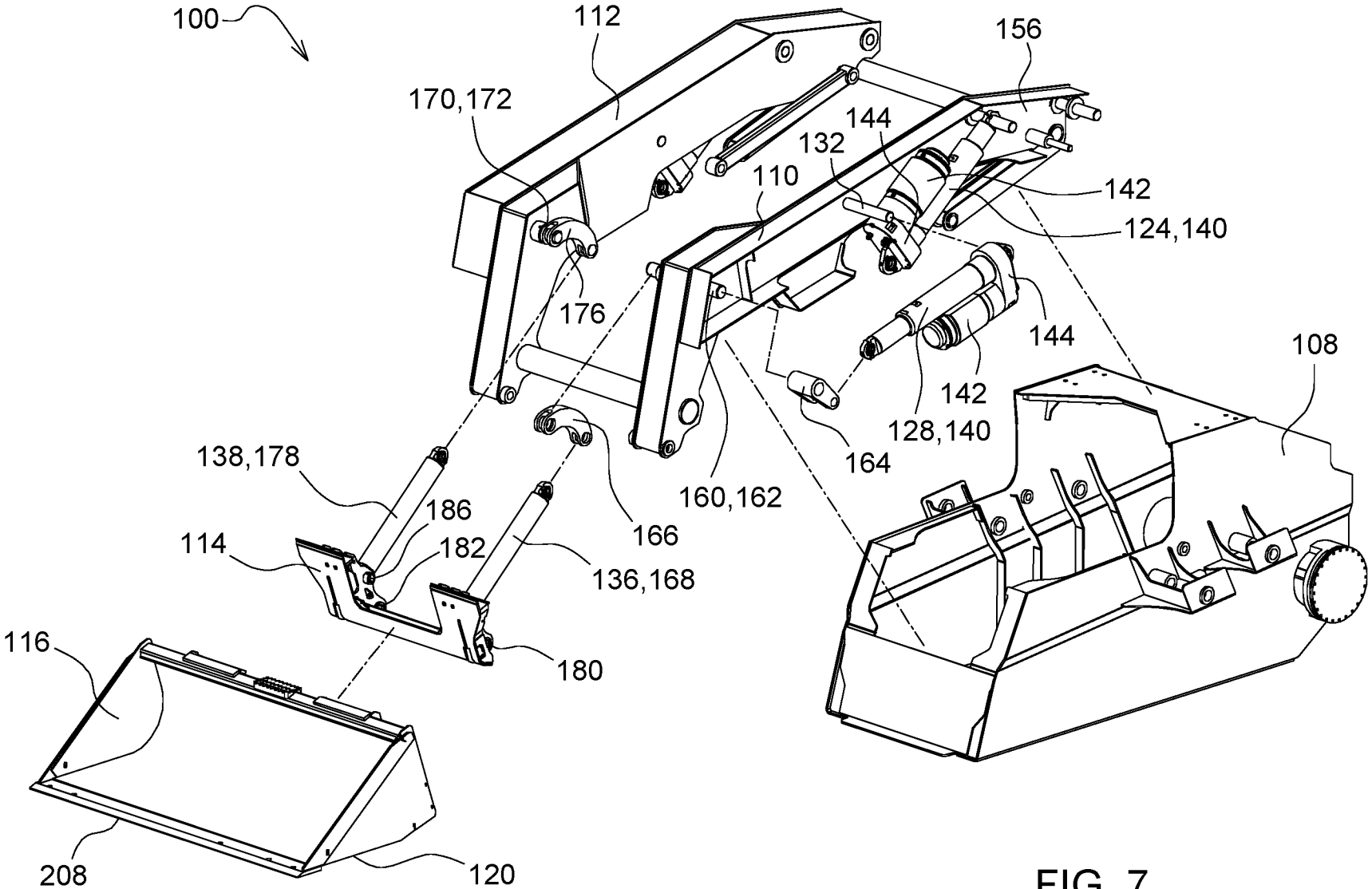
FIG. 7 is an exploded partial view of the construction machine of FIG. 2 mainly showing the boom arms and actuator linkages.

Referring to FIG. 7, left actuator linkage 136 connects the left work tool actuator 128 with the work tool coupling 114. Right actuator linkage 138 connects the right work tool actuator 130 with the work tool coupling 114.

Figure 3:
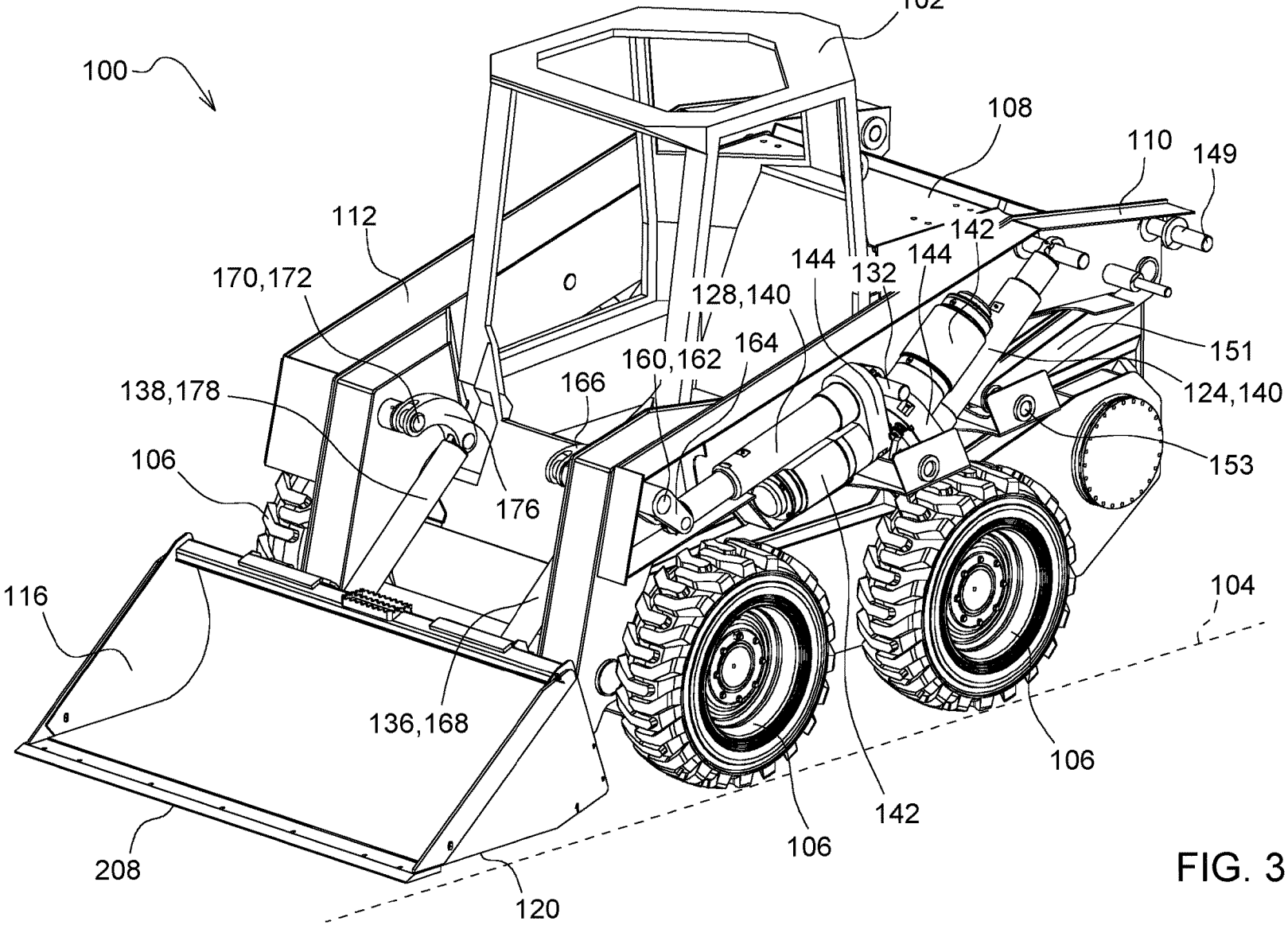
FIG. 3 is a perspective view of the construction machine of FIG. 2 where a left boom arm is partially deconstructed. A left work tool actuator is illustrated as an electrically powered linear actuator.
Figure 4:
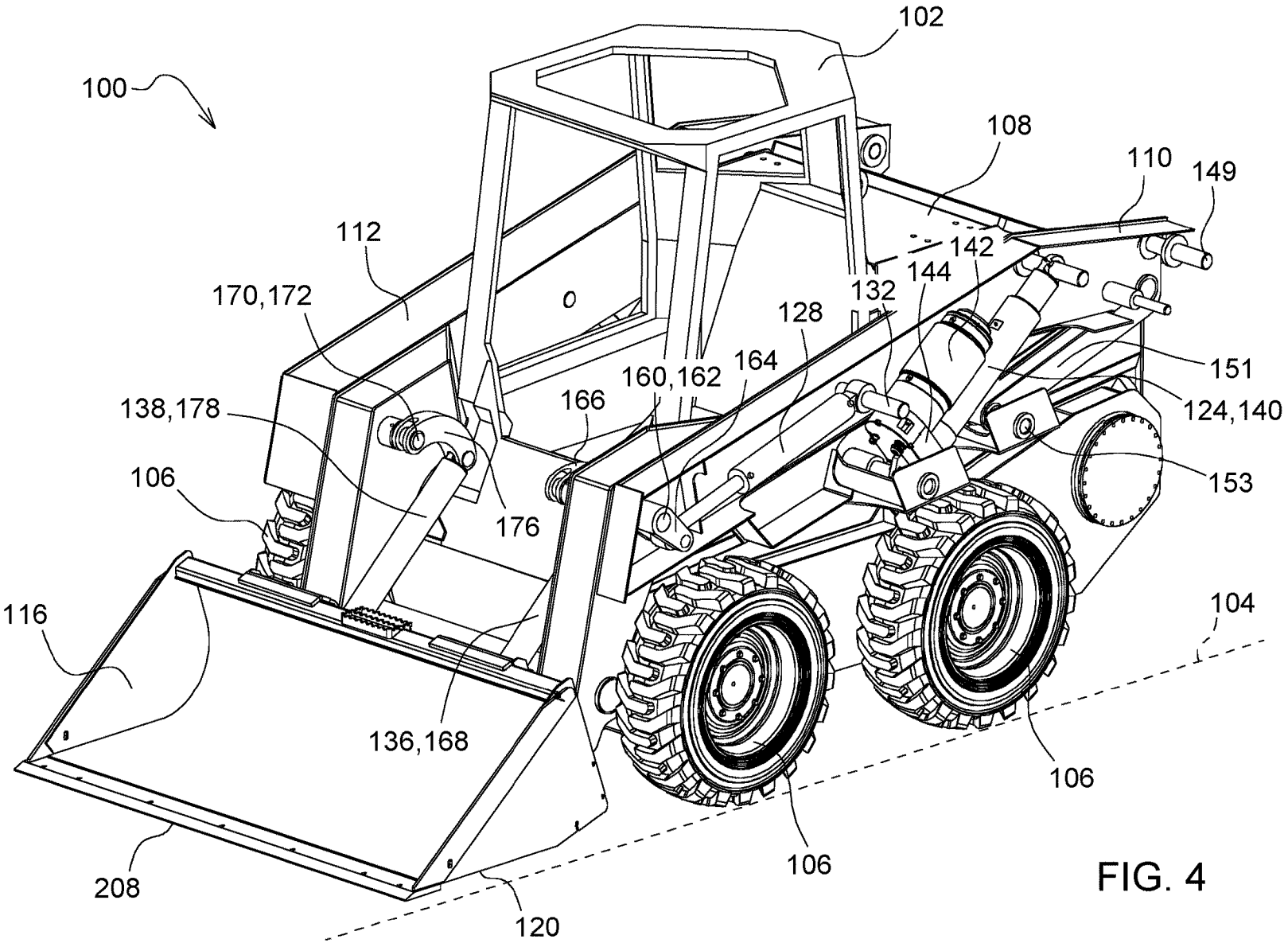
FIG. 4 is a perspective view of the construction machine of FIG. 2 where the left boom arm is partially deconstructed. The left work tool actuator is illustrated as a hydraulic cylinder.
Figure 8:
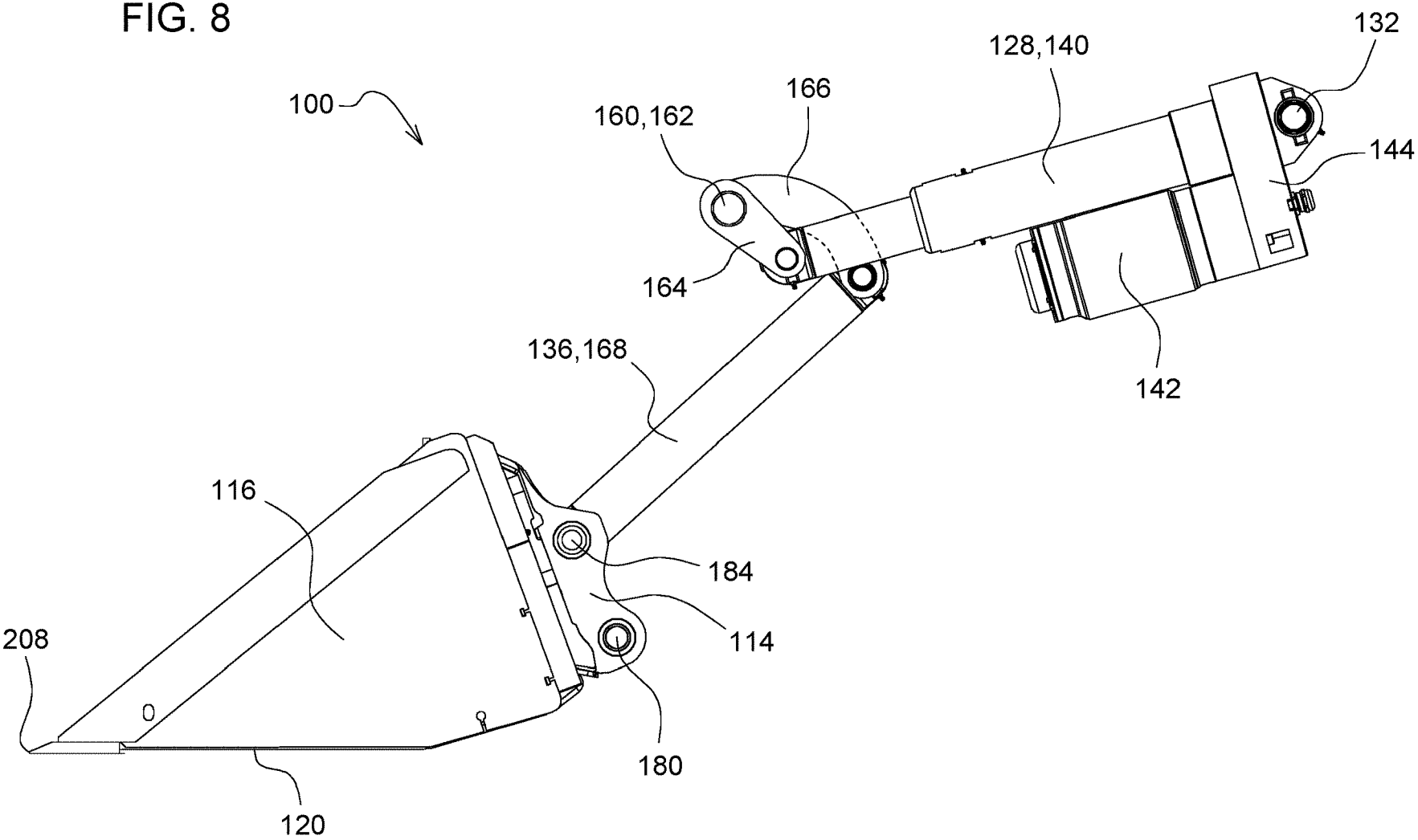
FIG. 8 is a left side partial view of the construction machine of FIG. 2 mainly showing the work tool actuator, actuator linkage, and work tool coupling.

Work tool actuators 128 and 130 can be hydraulic cylinders or electrically powered linear actuators. FIG. 3 illustrates the left work tool actuator 128 as an electrically powered linear actuator. FIG. 4 illustrates the left work tool actuator 128 as a hydraulic cylinder. Each electrically powered linear actuator comprises a rotary spindle and nut drive 140, an electric actuator motor 142, and a gearbox 144 coupling the actuator motor 142 to the rotary spindle and nut drive 140, as shown in FIG. 8. This is an example of one type of electrically powered linear actuator. Other types of electrically powered linear actuators could be used, such as belt driven linear actuators and rack and pinion driven linear actuators, to name a few examples.

Referring to FIGS. 5, 6, and 7, the boom arms 110 and 112 each include a main boom arm portion 146 extending longitudinally from a rear boom arm end 148 and bending downwardly at a boom knee 150 to a lower boom arm portion 152 having a forward boom arm end 154. The rear boom arm end 148 is pivotally supported directly or indirectly from the machine frame 108. In the illustrated embodiment the rear boom arm end 148 is pivotally connected at 149 to an intermediate supporting arm 151 which is pivotally connected to machine frame 108 at 153. The boom arms 110 and 112 are hollow and include an inner wall 156 and an outer wall 158.

The left actuator linkage 136 comprises a bell crank 160 pivotally mounted on the left boom arm 110. The bell crank 160 includes a crank shaft 162, a first crank arm 164, and a second crank arm 166. The first crank arm 164 and the second crank arm 166 extend from the crank shaft 162. The left actuator linkage 136 further comprises a rigid actuator link 168 pivotally connected at one end to the second crank arm 166 and pivotally connected at another end to the work tool coupling 114.

The right actuator linkage 138 comprises a bell crank 170 pivotally mounted on the right boom arm 112. The bell crank 170 includes a crank shaft 172, a first crank arm 174, and a second crank arm 176. The first crank arm 174 and the second crank arm 176 extend from the crank shaft 172. The right actuator linkage 138 further comprises a rigid actuator link 178 pivotally connected at one end to the second crank arm 176 and pivotally connected at another end to the work tool coupling 114.

The left work tool actuator 128 and the first crank arm 164 of the left actuator linkage 136 are at least partially housed within the left boom arm 110. The right work tool actuator 130 and the first crank arm 174 of the right actuator linkage 138 are at least partially housed within the right boom arm 112. The left and right work tool actuators 128 and 130 can also be completely housed within the left and right boom arms 110 and 112, respectively. The second crank arm 166 of the left actuator linkage 136 and the second crank arm 176 of the right actuator linkage 138 are located between the left and right boom arms 110 and 112. The rigid actuator link 168 of the left actuator linkage 136 and the rigid actuator link 178 of the right actuator linkage 138 are located between the left and right boom arms 110 and 112.

Work tool coupling 114 includes a left boom connection point 180, a right boom connection point 182, a left actuator connection point 184, and a right actuator connection point 186. The forward boom arm end 154 of the left boom arm 110 is pivotally connected to the left boom connection point 180. The forward boom arm end 154 of the right boom arm 112 is pivotally connected to the right boom connection point 182. The left and right actuator linkages 136 and 138 connect the left and right work tool actuators 128 and 130 with the work tool coupling 114. Specifically, the rigid actuator link 168 of the left actuator linkage 136 is pivotally connected at one end to the left actuator connection point 184. The rigid actuator link 178 of the right actuator linkage 138 is pivotally connected at one end to the right actuator connection point 186.

Figure 9:
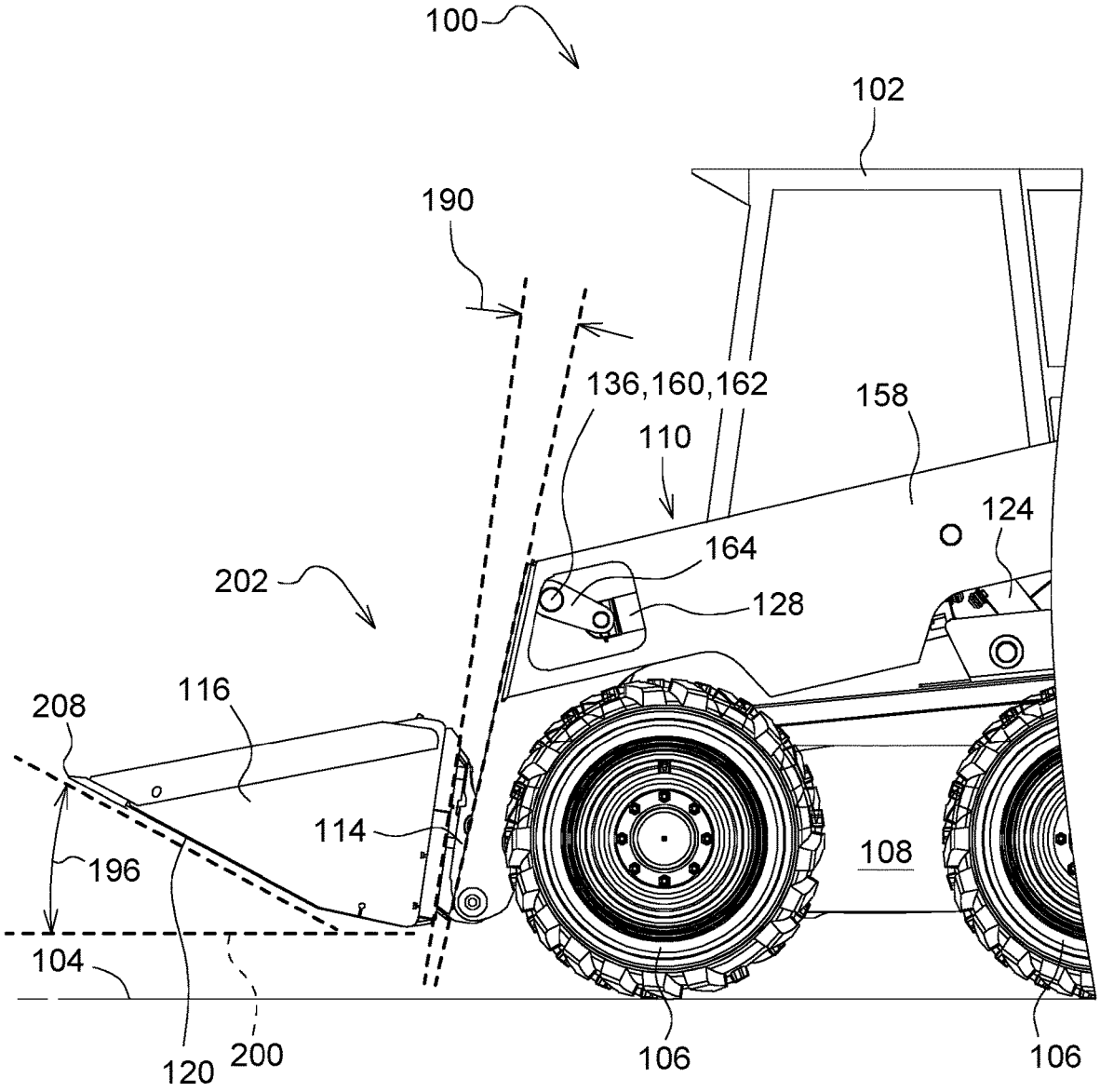
FIG. 9 is a left side partial view of the construction machine of FIG. 2 showing a rollback angle.

Referring to FIGS. 9 and 10, the left and right actuator linkages 136 and 138 are configured such that the work tool coupling 114 is pivotable relative to the boom arms 110 and 112 through a range between a downward most angle 188 and an upward most angle 190. The range between the downward most angle 188 and the upward most angle 190 is between 120 and 140 degrees, but is preferably 130 degrees. The left and right work tool actuators 128 and 130 each include a linear actuator that extends between a retracted position and an extended position. In the downward most angle 188, the left and right work tool actuators 128 and 130 are in the extended position. FIG. 10 illustrates the work tool coupling 114 in the downward most angle 188.

In the upward most angle 190, the left and right work tool actuators 128 and 130 are in the retracted position. FIG. 9 illustrates the work tool coupling 114 in the upward most angle 190.

The left and right actuator linkages 128 and 130 are configured such that the construction machine 100 has a rollback angle 196 of at least 20 degrees, preferably at least 25 degrees, and most preferably at least 30 degrees. In the illustrated embodiment of FIG. 9, the rollback angle 196 is shown as 30 degrees. The rollback angle 196 is the angle between the planar bottom of the bucket 120 and a horizontal plane 200 at a lowest boom location 202. The left and right actuator linkages 128 and 130 are further configured such that the construction machine 100 has a dump angle 198 of at least 30 degrees, preferably at least 40 degrees, and most preferably at least 42 degrees. In the illustrated embodiment of FIG. 10, the dump angle 198 is shown as 42 degrees. The dump angle 198 is the angle between the planar bottom of the bucket 120 and a horizontal plane 204 at a highest boom location 206.

The left and right work tool actuator linkages 136 and 138 are configured such that the extension and retraction of the work tool actuators 128 and 130 pivot the first crank arms 164 and 174 about the crank shafts 162 and 172. The rotation of the crank shafts 162 and 172 pivots the second crank arms 166 and 176 about the crank shafts 162 and 172. The second crank arms 166 and 176 translate the rigid actuator links 168 and 178 which pivot the work tool coupling 114 relative to the boom arms 110 and 112.

Figure 11:
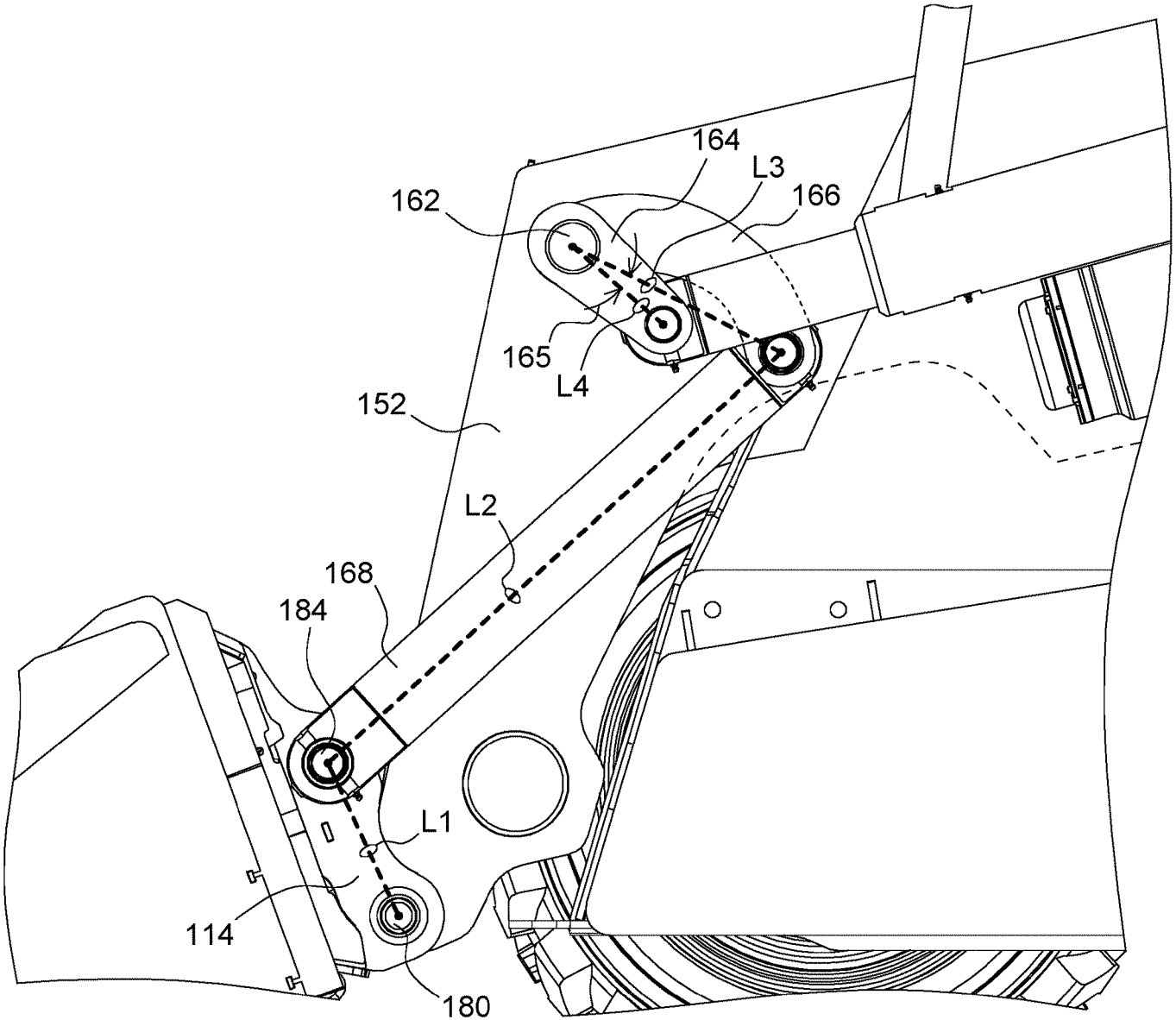
FIG. 11 is a left side elevation view of the actuator linkage identifying the lengths of each link L1, L2, L3 and L4.

One example of the relative lengths of the links of the work tool actuator linkages 136 and 138 is illustrated in FIG. 11 and the dimensions are set forth in the following Table. In the Table L1 is the distance between left boom connection point 180 and left actuator connection point 184. L2 is the length of the rigid actuator link 168 between its pivotal connection points. L3 is the length of the second crank arm 166 between its pivotal connection points. L4 is the length of the first crank arm 164 between its pivotal connection points. The angle between L3 and L4 is measured in degrees about the axis of crank shaft 162. Dx is the horizontal distance between the axis of crank shaft 162 and the left boom connection point 180 when the boom arm is in its lowest position as illustrated. Dy is the vertical distance between the axis of crank shaft 162 and the left boom connection point 180 when the boom arm is in its lowest position as illustrated. The Table gives one example of actual dimensions. It gives the nominal ratio of those actual dimensions. The bottom line of the Table gives a preferred range for the indicated ratio. Per these preferred ratios the rigid actuator link 168 has a length L2 in a range of from 3.5 to 3.7 times a distance L1 between the left boom connection point and the left actuator connection point. The first crank arm 164 has a length L4 in a range of from 0.6-0.8 times the distance L1 between the left boom connection point and the left actuator connection point. The second crank arm 166 has a length L3 in a range of from 1.3-1.5 times the distance L1 between the left boom connection point and the left actuator connection point. The first and second crank arms 164 and 166 have an angle 165 therebetween about the axis of the crank shaft 162 in a range of 13.6 to 14 degrees. The distance Dx is in a range of 1.1-1.3 times the distance L1 between the left boom connection point and the left actuator connection point. The distance Dy is in a range of 3.9-4.1 times the distance L1 between the left boom connection point and the left actuator connection point.

| | L1 | L2 | L3 | L4 | Dx | Dy | Angle between L3 & L4 |
|---|---|---|---|---|---|---|---|
| Dimen-sion | 183 | 665.73 | 254.7 | 129.76 | 227.2 | 727.95 | 13.8 |
| Nominal Ratio | 1.0 | 3.6 | 1.4 | 0.7 | 1.2 | 4.0 | NA |
| Range | | 3.5-3.7 | 1.3-1.5 | 0.6-0.8 | 1.1-1.3 | 3.9-4.1 | 13.6-14 |

Figure 1:
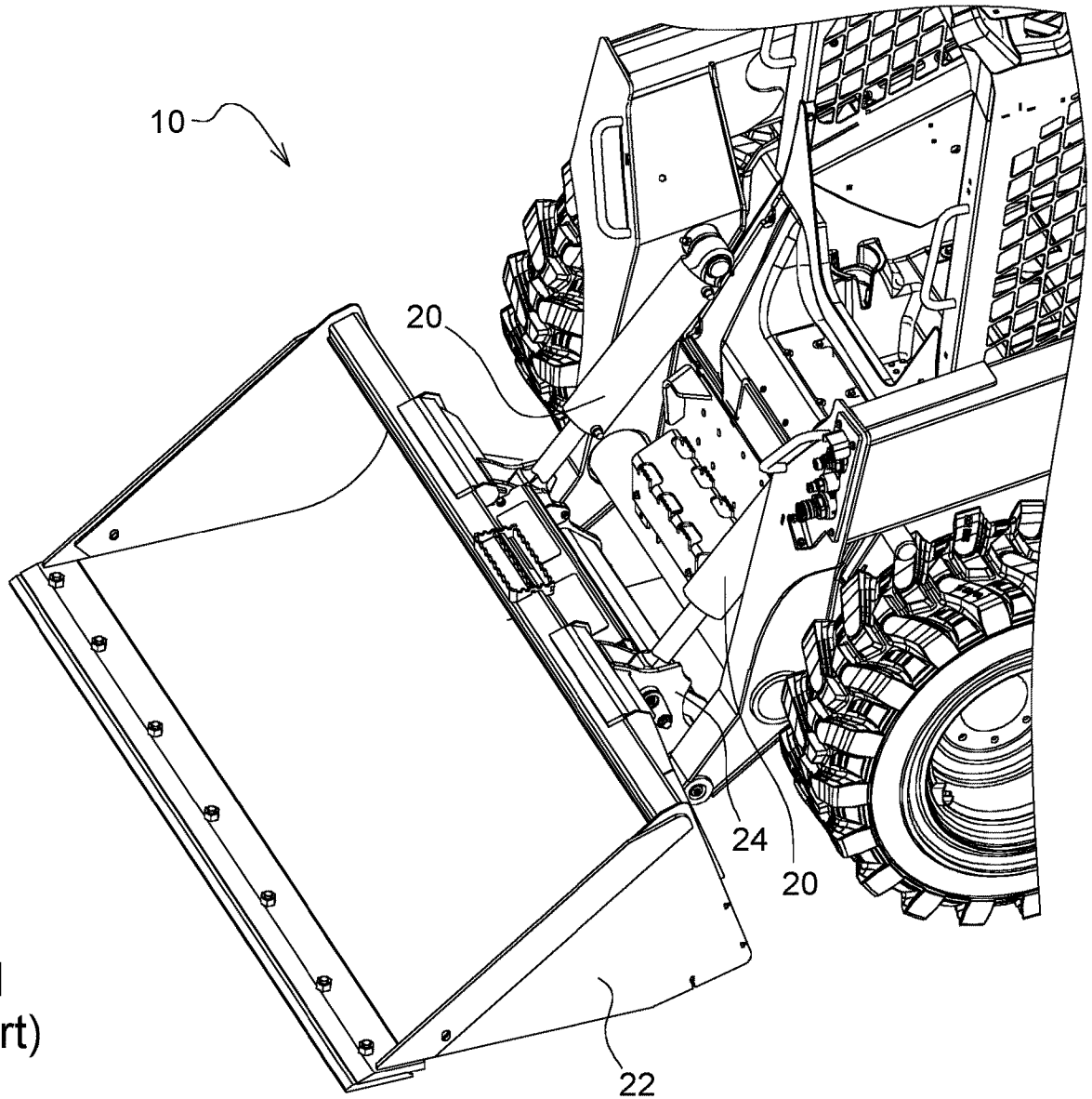
FIG. 1 (Prior Art)
FIG. 1 is a perspective partial view of a conventional construction machine, for example a skid steer loader, with a work tool coupling and work tool connected to the front of the work vehicle.

Prior art construction machines, like the conventional construction machine 10 shown in FIG. 1, place the work tool actuators in front of the operator station and directly connect the actuators to the work tool or work tool coupling. The present disclosure relocates, mounts, and hides the work tool actuators 128 and 130 inside the boom arms 110 and 112, respectively. The actuator linkages 136 and 138 include unique linkage ratios configured such that the construction machine 100 achieves the same, if not better, level of work tool performance as the prior art construction machine of comparable size.

The new location of the work tool actuators 128 and 130 is further from the debris environment and the work tool actuators 128 and 130 are at least partially protected by the boom arms 110 and 112 thereby reducing failures associated with the work tool actuators 128 and 130. The present disclosure also places the work tool actuators 128 and 130 closer to a work tool actuator power source thereby reducing the length of hydraulic lines or electrical wiring needed to connect the work tool actuators 128 and 130 to the work tool actuator power source. The placement of the work tool actuators 128 and 130 inside the boom arms 110 and 112 allows for more packaging space when larger actuators are used, such as electrically powered linear actuators. Moving the work tool actuators 128 and 130 away from the front of the machine also provides more space for an operator to climb into and out of the operator station 102.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A construction machine, comprising:

a machine frame;

a plurality of ground engaging units for supporting the machine frame from a ground surface;

a work tool coupling;

left and right boom arms pivotally supported directly or indirectly from the machine frame and pivotally connected to the work tool coupling;

left and right work tool actuators mounted on the left and right boom arms, respectively; and left and right actuator linkages connecting the left and right work tool actuators, respectively, with the work tool coupling, wherein the left and right actuator linkages each comprise:

a bell crank pivotally mounted on the respective boom arm, the bell crank including a crank shaft pivotally mounted in a fixed position on the respective boom arm and first and second crank arms extending from the crank shaft at a fixed angle relative to each other, the first crank arm being pivotally connected to a respective one of the work tool actuators; and a rigid actuator link pivotally connected at one end to the second crank arm and pivotally connected at another end to the work tool coupling.

2. The machine of claim 1, wherein:

the work tool coupling includes left and right boom connection points and left and right actuator connection points;

each of the left and right boom arms includes a main boom arm portion extending longitudinally from a rear boom arm end and bending downwardly at a boom knee to a lower boom arm portion having a forward boom arm end, the rear boom arm end being pivotally supported directly or indirectly from the machine frame, the forward boom arm end being pivotally connected to one of the boom connection points of the work tool coupling; and the left and right actuator linkages connect the left and right work tool actuators with the left and right actuator connection points, respectively.

3. The machine of claim 2, wherein:

the left and right work tool actuators are mounted on the main boom arm portions of the left and right boom arms, respectively.

4. The machine of claim 3, wherein:

each of the left and right work tool actuators is pivotally connected to the boom arm at a pivotal connection, the pivotal connection configured to move with the boom arm.

5. The machine of claim 1, wherein:

the left and right work tool actuators and the first crank arms are at least partially housed within the left and right boom arms, respectively.

6. The machine of claim 1, wherein:

the second crank arms are between the left and right boom arms.

7. The machine of claim 1, wherein:

the rigid actuator links are between the left and right boom arms.

8. The machine of claim 1, wherein:

the left and right work tool actuators are hydraulic cylinders.

9. The machine of claim 1, wherein:

the linkage is configured such that the work tool coupling is pivotable relative to the boom arms through a range between a downward most angle and an upward most angle, the range being between 120 degrees and 140 degrees.

10. The machine of claim 9, wherein:

the left and right work tool actuators each include a linear actuator extending between a retracted position and an extended position, the left and right work tool actuators being in the retracted position when the work tool coupling is in the upward most angle, and the left and right work tool actuators being in the extended position when the work tool coupling is in the downward most angle.

11. The machine of claim 9, further comprising:

a bucket operatively coupled with or including the work tool coupling, the bucket including a planar bottom; and wherein the linkage is configured such that a rollback angle between the planar bottom of the bucket and a horizontal plane at a lowest boom location is at least 20 degrees, and a dump angle between the planar bottom of the bucket and a horizontal plane at a highest boom location is at least 30 degrees.

12. The machine of claim 1, further comprising:

left and right boom support actuators for moving the left and right boom arms along a lift path, the left and right boom support actuators being pivotally coupled at one end to the machine frame and at an opposite end to the left and right boom arms, respectively.

13. The machine of claim 1, wherein:

each of the left and right boom arms is hollow and includes an inner wall and an outer wall.

14. The machine of claim 1, wherein:

the work tool coupling includes left and right boom connection points and left and right actuator connection points;

each of the left and right boom arms includes a main boom arm portion extending longitudinally from a rear boom arm end and bending downwardly at a boom knee to a lower boom arm portion having a forward boom arm end, the rear boom arm end being pivotally supported directly or indirectly from the machine frame, the forward boom arm end being pivotally connected to one of the boom connection points of the work tool coupling;

the left and right actuator linkages connect the left and right work tool actuators with the left and right actuator connection points, respectively the rigid actuator link has a length in a range of from 3.5 to 3.7 times a distance between the left boom connection point and the left actuator connection point;

the first crank arm has a length in a range of from 0.6-0.8 times the distance between the left boom connection point and the left actuator connection point;

the second crank arm has a length in a range of from 1.3-1.5 times the distance between the left boom connection point and the left actuator connection point; and the first and second crank arms have an angle therebetween about the axis of the crank shaft in a range of 13.6 to 14 degrees.

15. A construction machine, comprising:

a machine frame;

a plurality of ground engaging units for supporting the machine frame from a ground surface;

a work tool coupling;

left and right boom arms pivotally supported directly or indirectly from the machine frame and pivotally connected to the work tool coupling;

left and right work tool actuators mounted on the left and right boom arms, respectively; and left and right actuator linkages connecting the left and right work tool actuators, respectively, with the work tool coupling;

wherein each of the left and right boom arms is hollow and includes a hollow space between an inner wall and an outer wall;

wherein the left and right work tool actuators are at least partially house within the hollow space of the left and right boom arms, respectively, between the inner wall and the outer wall of the respective boom arm.

16. The machine of claim 15, wherein:

the left and right work tool actuators are completely housed within the left and right boom arms, respectively.

17. The machine of claim 15, wherein:

the left and right work tool actuators are electrically powered linear actuators; and the left and right electrically powered linear actuators are at least partially housed within the left and right boom arms, respectively, between the inner wall and the outer wall of the respective boom arm.

18. The machine of claim 17, wherein each electrically powered linear actuator comprises:

a rotary spindle and nut drive;

an electric actuator motor; and a gearbox coupling the actuator motor to the rotary spindle and nut drive.

* * * * *